US008727122B2

(12) United States Patent
Jacquet et al.

(10) Patent No.: US 8,727,122 B2
(45) Date of Patent: May 20, 2014

(54) PACKAGE FOR A FRAGRANCE CONTAINING TABLET

(75) Inventors: Fabienne Jacquet, Union City, NY (US); Caroline Fontana, Puteaux (FR); Jacques LaLanne, Compiegne (FR)

(73) Assignee: Colgate-Palmolive Company, New York, NY (US)

( * ) Notice: Subject to any disclaimer, the term of this patent is extended or adjusted under 35 U.S.C. 154(b) by 2701 days.

(21) Appl. No.: 10/572,140

(22) PCT Filed: Sep. 15, 2004

(86) PCT No.: PCT/US2004/030055

§ 371 (c)(1),
(2), (4) Date: Jan. 3, 2007

(87) PCT Pub. No.: WO2005/028334

PCT Pub. Date: Mar. 31, 2005

(65) Prior Publication Data

US 2007/0193916 A1 Aug. 23, 2007

(30) Foreign Application Priority Data

Sep. 15, 2003 (FR) ..... 03 10801

(51) Int. Cl.
*B65D 85/30* (2006.01)
*B65D 77/06* (2006.01)

(52) U.S. Cl.
USPC ..... 206/540; 206/526; 206/77.1

(58) Field of Classification Search
USPC ..... 206/526, 528, 540, 581, 77.1
See application file for complete search history.

(56) References Cited

U.S. PATENT DOCUMENTS

| | | | | |
|---|---|---|---|---|
| 5,135,795 | A | 8/1992 | Gregory et al. | |
| 5,879,151 | A * | 3/1999 | Schultz et al. | 215/320 |
| 6,007,854 | A | 12/1999 | Cadiente et al. | |
| 6,085,930 | A | 7/2000 | Curtis | |
| 6,629,606 | B1 * | 10/2003 | Barthel et al. | 206/526 |
| 6,971,511 | B2 * | 12/2005 | Holmon | 206/232 |
| 2003/0077363 | A1 | 4/2003 | Cadiente et al. | |

FOREIGN PATENT DOCUMENTS

| | | | |
|---|---|---|---|
| DE | 10027672 | A1 * | 12/2001 |
| EP | 0 899 208 | A1 | 3/1999 |
| FR | 1 258 371 | A | 4/1961 |
| GB | 2 094 273 | | 9/1982 |
| WO | WO 89/03789 | | 5/1989 |

OTHER PUBLICATIONS

Translation of DE 100 27 672 A1.*

* cited by examiner

*Primary Examiner* — J. Gregory Pickett
(74) *Attorney, Agent, or Firm* — Judy W. Chung

(57) ABSTRACT

The tablet package comprises a container (10) and a sealed primary package or pouch (42) which holds the tablets (40) within the container. The container will have one or more relatively small apertures (18, 28, 30, 32) on a wall of the container. The lid (14) is a wall of the container. The bag or pouch will be of a material and a material thickness so that some of the fragrance within the tablet can pass through the primary package or pouch and into the container. Such fragrance then can pass from the container through an aperture by the potential purchaser prior to a purchase.

14 Claims, 4 Drawing Sheets

PACKAGE FOR A FRAGRANCE CONTAINING TABLET

FIELD OF THE INVENTION

This invention relates to a package for a fragrance containing tablet wherein a sample of the tablet fragrance can be sensed outside of the package.

BACKGROUND OF THE INVENTION

In the use of the fragranced products the user in many instances wants to detect the fragrances prior to making a purchase. With tablets there can be more than one layer of packaging. The tablets will be packaged in a primary package to protect the tablets during shipping and handling and an outer container to hold the primary package. The primary package can be flexible and resilient and the outer container rigid to semi-rigid to provide a stackable unit. The primary package can contain the tablets individually or in a collection of two or more. The primary package also will hold any dust from the tablets when collectively packaged. A dust can result from the contact of the tablets during shipping and handling. The problem is that with a primary package and an outer container the customer will not be able to reasonably perceive the fragrance of the tablets. In order to solve this problem both the primary package prior to purchase and the outer container must be modified. The primary package has to be modified to provide for a low level of transmissivity of the fragrance. The outer container has to be modified or chosen to allow some fragrance from the primary package to be emitted when the container is handled.

It is needed to modify the outer container since if a way of perceiving the fragrances through the outer container is not possible consumers will open the outer container to smell the fragrance. This will result in the destruction of any tamper evident seal. Thus the primary package and the outer container both need to be chosen and/or modified to solve the problem.

The fragrance containing tablets can be those used to provide a refreshing fragrance to a room or other space, those incorporating a detergent for cleaning laundry and those including a fabric softener. The tablet can have the sole function of providing a fragrance directly to a space or can be in combination with another component and have two functions.

BRIEF SUMMARY OF THE INVENTION

This invention is directed to an overall package for a tablet that contains a fragrance. The package is comprised of a primary package and an outer container. The primary package has a structure that holds a single tablet or will hold a plurality of tablets. It will be in a bag form for holding a plurality of tablets. The film of the primary package will have a perceptible transmissivity for the tablet fragrance for at least six months. Preferably there should be a transmissivity of at least about 0.1 $cm^3/m^2$/day/bar at room temperate and atmospheric pressure, and preferably at least about 1 $cm^3/m^2$/day/bar of fragrance containing air. Fragrance containing air is air with a fragrance content such that the fragrance can be readily perceived by persons from the public. However, the film of the primary package should not transmit more than about 50%, and preferably not more than about 25%, of the tablet fragrance content at room temperature and atmospheric pressure over a period of 120 days.

The outer container will be comprised of a rigid to semi-rigid thermoplastic, preferably having an openable or removable lid. On a surface of the container there will be least one, and preferably more than one aperture for the passage of fragrance from the interior of the container to the exterior of the container. The apertures will have a total area of about 1 sq. mm up to about 25 sq. mm and preferably about 5 sq. mm up to about 15 sq. mm. In this way the apertures in the outer container and the fragrance transmissivity of the film containing the fragrance tablet will allow sufficient fragrance to pass through the container apertures so that the consumer can detect the fragrance prior the purchase.

DETAILED DESCRIPTION OF THE DRAWINGS

Figure 1:
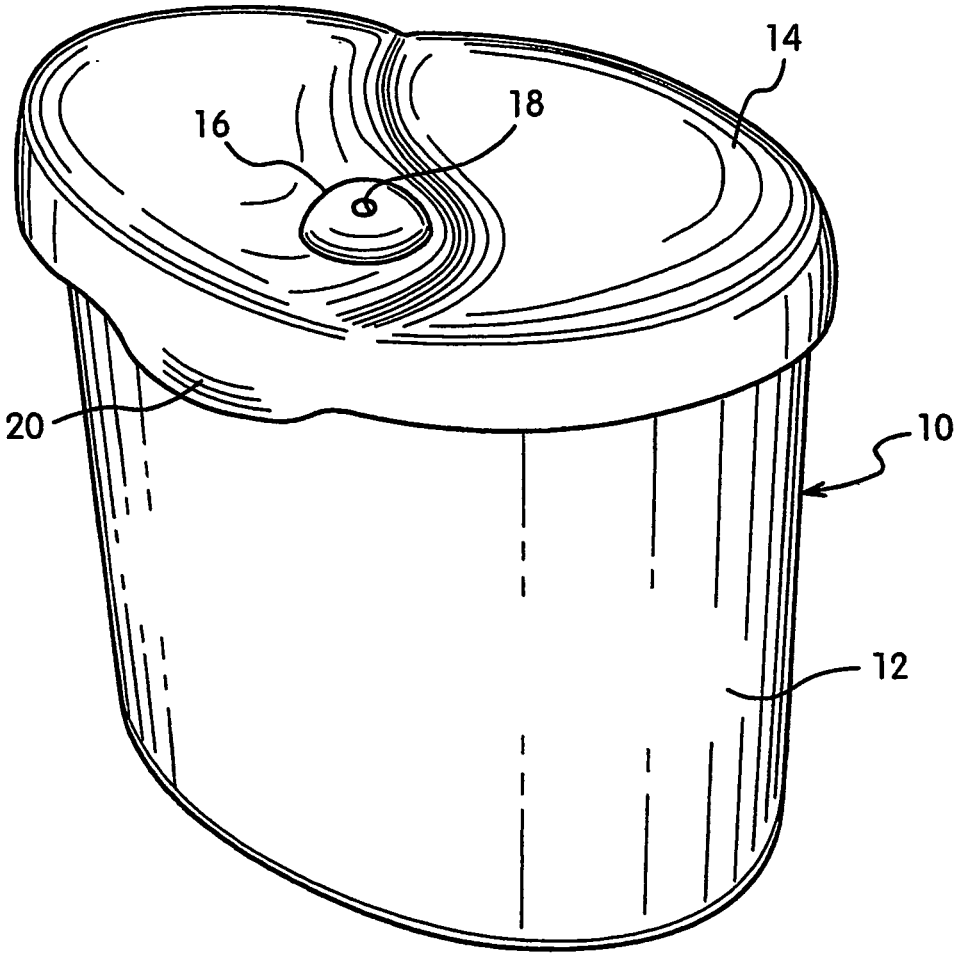
FIG. 1 is a perspective view of the container.

The invention will be described in its preferred embodiments with reference to the Figures in the drawings.

Figure 2:
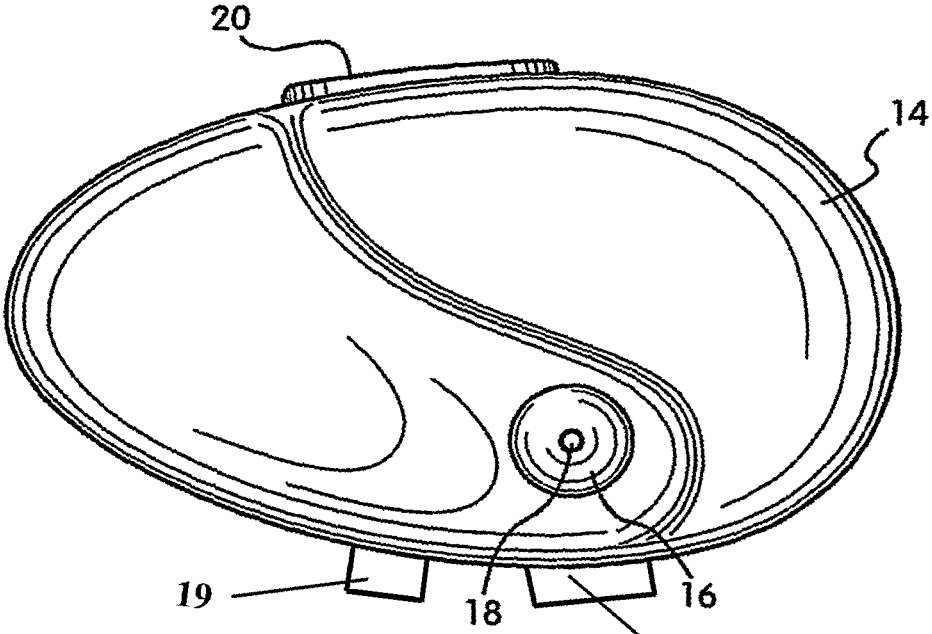
FIG. 2 is a top plan view of the container.
Figure 3:
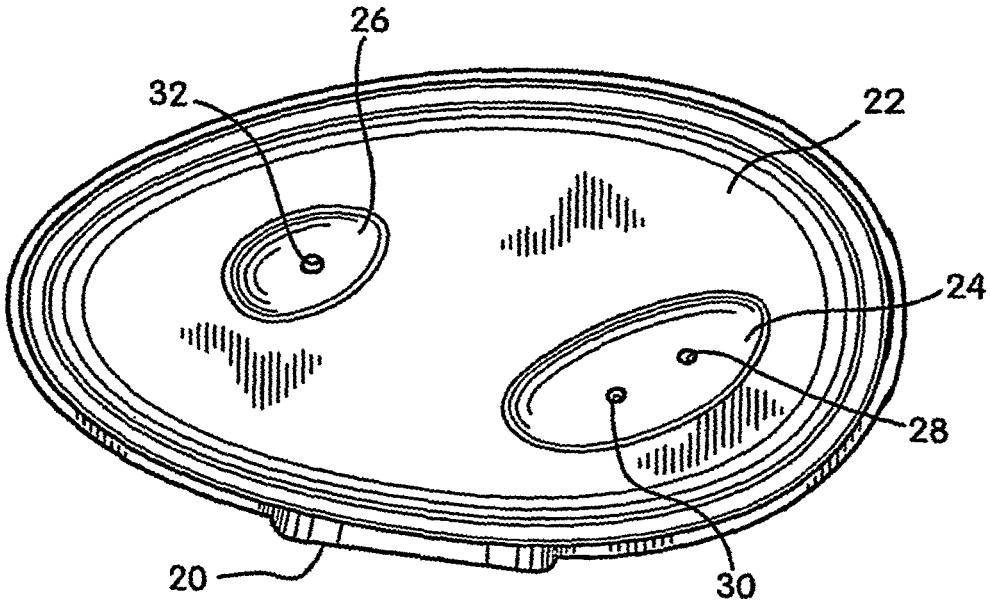
FIG. 3 is a bottom plan view of the container.

FIGS. 1 to 3 shows the container 10 comprised of sidewall 12 and lid 14. The lid has a lift tab 20 and a projection 16. The projection 16 has an aperture 18. The container 10 is shown as a decorative oval-like shape with the lid having a decorative undulating shape. However the container, as well as its lid, can be of essentially any shape. The only qualification is that all walls of the container and the lid should be continuous except for a possible lid aperture 18 and/or base apertures 28, 30, 32. The base is shown with three apertures. The lid can have more than one aperture and the apertures can be at another location on the lid. The apertures also can be in a side surface.

FIG. 2 is a top plan view of the lid. This view shows the contour on the lid surface in more detail. FIG. 3 shows the base of the container in a plan view. This is comprised of a base surface 22 with recesses 24 and 26. Recess 24 has two apertures 28 and 30 and recess 26 has aperture 32. The apertures preferably are placed in the recesses to prevent the recesses from becoming clogged with shipping carton debris during shipping and other debris at the point of sale.

The apertures will have a total surface area of about 0.5 sq. mm to about 25 sq. mm and preferably about 5 sq./mm to about 15 sq. mm. The aperture can be of essentially any shape. For illustrative purposes in the Figures they are shown as circular.

The container can be made of any material. Plastics are preferred and thermoplastics are most preferred. Useful thermoplastics include polyolefins such as polyethylene and polypropylene and polyesters such as polyethylene terephthalate.

Figure 4:
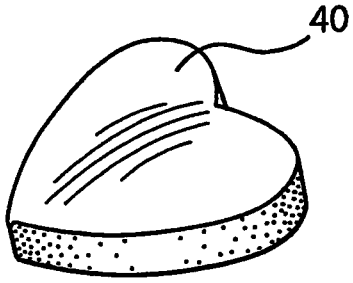
FIG. 4 is a perspective view of a heart tablet.
Figure 5:
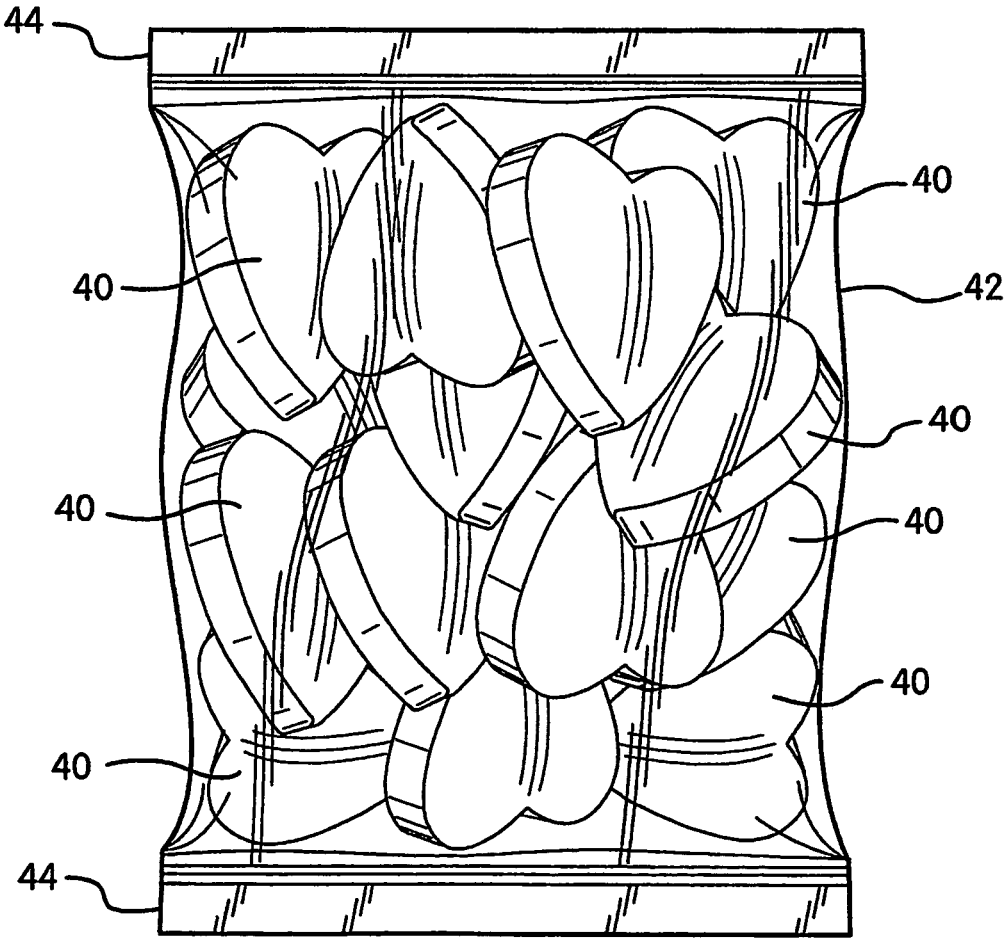
FIG. 5 is an elevational view of a primary package with a plurality of tablets.

FIG. 4 shows a heart shaped tablet 40 and FIG. 5 shows a plurality of tablets 40 in a closed bag 42. The bag has a seal 44 on each end. Such bags can have three or more sides depending on the bag structure. If formed from two sheets of film it will be sealed on all edges. If formed from a single sheet there will be three sealed edges. The tablets 40 are shown as being heart shaped but they can be of essentially any shape and size. Generally the tablets will be about 0.5 cm to about 5 cm in a major dimension and about half or more of the major dimension in the minor dimension. The tablets will contain a fragrance as part of their structure. The fragrance content will be from about 0.2% to about 8% of the weight of the tablet, and preferably about 1% to about 4%. The bag 42 will be of a material, and a thickness of such material, such as that organic substances, such as fragrances in a vapor form in a mixture with air will pass through the film at a rate of at least 0.1 $cm^3/m^2$/day/bar at room temperature and atmospheric pressure and preferably at least about 1 $cm^3$/m/day/bar. This transmissivity should not exceed more than about 50%, and preferably not more than about 25% of the tablet fragrance content at room temperature and pressure over a period of 120 days. Room temperature is nominally 25° C.

Although shown in FIG. 4 as a plurality of tablets in the primary package the tablets can be packaged individually in primary packages. In such a case the container will contain a plurality of tablets each in a primary package.

The fragrance that is transmitted through the film of the primary package should also transmit a perceptible amount of the fragrance to a person for up to about 6 months. The test on the transmissivity of the fragrance consists of placing the primary package of tablets in a container having a volume of four liters of atmospheric air. The container is sealed and allowed to stand for 1 hour at room temperature (nominally 25° C.). After 1 hour a known volume sample of the air in the container is withdrawn. This sample of air/fragrance is analyzed by gas chromatography to determine the fragrance content of sample. This fragrance content then is used to calculate the amount of fragrance that is transmitted through the film to give a value in $cm^3/m^2$/day/bar. The value for this volume can be readily calculated since the $m^2$ value of the surface of the film package is known as are the other parameters of the equation.

The film will be a plastic having a thickness of about 25 microns to about 150 microns and preferably about 30 microns to 100 microns. The plastic can be water soluble or water unsoluble. Preferred plastics are polyolefins, polyesters, polyvinyl acetates and polyvinyl alcohols. Laminate films of various structures of these plastics can also be used. The requirements for the film are the film being able to contain the tablets without rupture, good scalability, and a fragrance transmissivity as set out above. When polyesters are used the film may be microperforated to assume a sufficient fragrance transmissivity so that it can be perceived by a purchaser through an aperture in the container.

Figure 6:
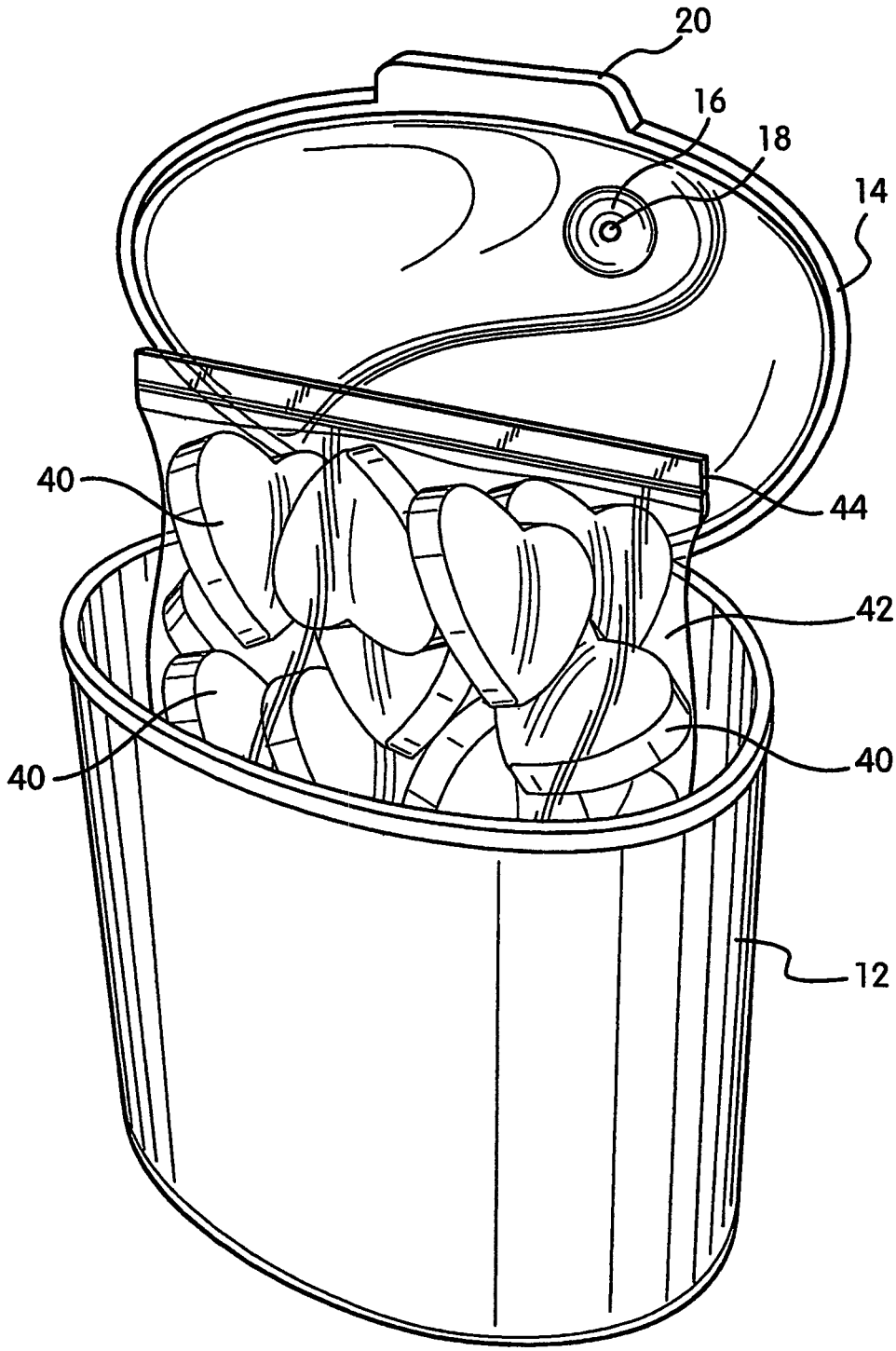
FIG. 6 is a view of the primary package in the container of FIG. 1.

FIG. 6 shows the tablets 40 in bag 42 in container 10. At the point of sale the lid 14 of the container will be closed. The lid 14 may be connected to the container by a hinge 17. The container as an option also may have a tamper evident seal 19 (FIG. 2).

At the point of sale a potential purchaser can detect the fragrance of the tablets by sniffing the air in the region of the aperture. This will aid in the decision to purchase the packaged tablets.

What is claimed is:

1. A package for a fragrance containing product comprising a tablet containing a fragrance, wherein the tablet comprises a detergent or fabric softener, the tablet contained within a primary package, said primary package having a perceptible transmissivity for said fragrance at room temperature and atmospheric pressure, the primary package containing the tablet being enclosed within a container, the container having at least one aperture on a surface thereof, wherein the container has a top surface having a projection and wherein the projection comprises at least one aperture, and wherein the projection has a convex outer surface, at least one aperture located on the convex outer surface.

2. A package as in claim 1 wherein the container has a bottom surface having at least one concavity, wherein the at least one concavity has a floor and wherein at least one aperture is in the floor of the concavity.

3. A package as in claim 1 wherein the bottom surface of the container has a first concavity having a first floor and a second concavity having a second floor, and wherein the first concavity comprises two apertures in the first floor and the second concavity comprises one aperture in the second floor.

4. A package as in claim 1 wherein said primary plastic package has a transmissivity for the fragrance of at least about 0.1 $cm^3/m^2$/day/bar at room temperature and atmospheric pressure.

5. A package as in claim 1 wherein a lower surface of the container has at least one recess.

6. A package as in claim 1 wherein the container is comprised of a base and a lid attached thereto, said lid and base having a tamper evident connection.

7. A package as in claim 6 wherein the lid is attached to the base by a hinge.

8. A package as in claim 1 wherein said primary package contains at least one tablet.

9. A package as in claim 8 wherein said primary package contains a plurality of tablets.

10. A package as in claim 1 wherein said primary package will not transmit more than 50% of the fragrance of said tablet over a period of 120 days.

11. A package as in claim 10 wherein said primary package will not transmit more than 25% of the fragrance of said tablets.

12. A package as in claim 1 wherein the fragrance from said tablets is perceptible though said primary package for at least 6 months.

13. A package as in claim 1 wherein the primary package is a film having a thickness between about 25 and 150 micrometers.

14. A package as in claim 13 wherein the film of the primary package has a thickness between about 30 micrometers and 100 micrometers.

* * * * *